US010926187B2

(12) United States Patent
Kennedy

(10) Patent No.: US 10,926,187 B2
(45) Date of Patent: Feb. 23, 2021

(54) MODULAR CONSTRUCTION PANELS AND FASTENERS THEREFOR

(71) Applicant: Feltro Inc., Toronto (CA)

(72) Inventor: Samuel Kennedy, Toronto (CA)

(73) Assignee: FELTRO INC., Toronto (CA)

( * ) Notice: Subject to any disclaimer, the term of this patent is extended or adjusted under 35 U.S.C. 154(b) by 0 days.

(21) Appl. No.: 16/267,801

(22) Filed: Feb. 5, 2019

(65) Prior Publication Data

US 2020/0246716 A1 Aug. 6, 2020

(51) Int. Cl.
*A63H 33/04* (2006.01)
*A63H 33/26* (2006.01)
*A63H 33/06* (2006.01)

(52) U.S. Cl.
CPC ..... *A63H 33/06* (2013.01); *A63H 33/26* (2013.01)

(58) Field of Classification Search
CPC ..... A63H 33/00; A63H 33/04; A63H 33/046; A63H 33/10; A63H 33/26; A44D 2203/00; A41F 1/002
USPC ..... 446/85, 92, 108, 113, 129; 24/303
See application file for complete search history.

(56) References Cited

U.S. PATENT DOCUMENTS 168,063 A 9/1875 Taylor
3,324,521 A * 6/1967 Humiston ..... E05C 19/16 24/303
3,372,443 A * 3/1968 Daddona, Jr. ..... A41F 1/002 24/303
3,462,803 A * 8/1969 Horton ..... B29C 66/30221 403/267
3,637,217 A 1/1972 Kent
3,661,689 A * 5/1972 Spanier ..... E04H 15/32 428/33
3,687,455 A 8/1972 Odier
4,182,063 A 1/1980 Klosel
4,227,334 A 10/1980 Hooker
4,265,002 A * 5/1981 Hosken ..... A41F 1/002 24/303
4,343,471 A 8/1982 Calvert
(Continued)

FOREIGN PATENT DOCUMENTS

CA 2051905 C 4/1998
CA 2366583 C 4/2008
(Continued)

OTHER PUBLICATIONS

Squashblox, online: http://daydreamtoy.com/our-toys/squashblox/.
(Continued)

*Primary Examiner* — Alexander R Niconovich
(74) *Attorney, Agent, or Firm* — Perry + Currier Inc.

(57) ABSTRACT

Units and fasteners for a modular construction set are provided. A unit includes a panel having a front surface and a back surface opposite the front surface. The panel is made of a flexible material that biases the panel to a flat state. The panel includes an aperture between the front surface and the back surface. The unit further includes a fastener affixed to the panel at the aperture, the fastener including a first piece and a second piece joinable to the first piece through the aperture to affix the fastener to the panel. The fastener further includes a magnet disposed between the first piece and the second piece to engage the fastener with an oppositely facing fastener of the modular construction set.

19 Claims, 12 Drawing Sheets

(56) References Cited

U.S. PATENT DOCUMENTS 4,459,714 A * 7/1984 Lin ..... A47C 27/081 24/581.12
4,674,982 A 6/1987 Mackey
4,676,507 A 6/1987 Patterson
4,736,494 A * 4/1988 Marchesi ..... A41F 1/002 24/303
5,301,953 A 4/1994 Levin
5,347,253 A * 9/1994 Ogikubo ..... A63F 9/12 273/239
5,409,236 A * 4/1995 Therrien ..... A63F 9/1204 273/156
5,762,529 A 6/1998 Nizza
5,819,448 A 10/1998 Kieves et al.
5,906,530 A * 5/1999 Lindsey ..... A63H 27/10 446/221
5,974,634 A * 11/1999 Eisenpresser ..... A44B 1/04 24/303
6,012,203 A * 1/2000 Baron Pearson ..... A41D 27/08 24/108
6,163,938 A * 12/2000 Weber-Unger ..... A41F 1/002 24/303
6,378,174 B1 * 4/2002 Wong ..... A41F 1/002 24/303
6,718,670 B2 4/2004 Wang
6,749,480 B1 * 6/2004 Hunts ..... A63H 33/046 446/85
7,065,841 B2 * 6/2006 Sjoquist ..... A41F 1/002 24/303
7,104,864 B1 * 9/2006 Liou ..... A63H 33/10 446/221
7,154,363 B2 * 12/2006 Hunts ..... H01F 7/0242 335/306
D569,064 S 5/2008 Hinder et al.
7,413,493 B2 * 8/2008 Toht ..... A63H 33/046 273/156
8,016,636 B2 * 9/2011 Park ..... A63H 33/046 446/92
8,070,550 B2 * 12/2011 Song ..... A63H 33/046 446/92
8,261,416 B2 * 9/2012 Rothbaum ..... H04R 1/1033 24/17 R
8,615,849 B2 * 12/2013 Rothbaum ..... H04M 1/15 24/16 R
8,631,517 B1 * 1/2014 Blakely ..... A41F 1/002 2/266
8,850,683 B2 * 10/2014 Haughey ..... A63H 33/046 29/428
9,113,739 B2 * 8/2015 Thomas ..... A47H 2/00
9,131,739 B1 * 9/2015 Sjoquist ..... A41F 1/002
9,238,180 B2 * 1/2016 Kennedy ..... A63H 33/10
9,266,015 B1 * 2/2016 Estrada ..... A63F 3/00694
9,375,057 B2 * 6/2016 Oakley ..... A44B 17/0011
9,392,829 B2 * 7/2016 Manuello ..... A41F 9/002
9,402,433 B2 * 8/2016 York ..... A42B 1/22
9,433,871 B2 * 9/2016 Park ..... A63H 33/102
9,574,355 B2 * 2/2017 Meyer ..... A47G 1/00
9,713,777 B2 * 7/2017 Peterson ..... B29C 65/56
9,801,439 B2 * 10/2017 Nie ..... A45C 3/001
9,814,998 B2 * 11/2017 Wei ..... A63H 33/10
9,820,520 B2 * 11/2017 Bolen ..... A44B 1/08
9,821,244 B1 * 11/2017 Whang ..... A63H 33/046
9,873,062 B2 * 1/2018 Purns ..... A63H 33/06
10,330,134 B2 * 6/2019 Danko ..... E05D 7/10
2004/0003487 A1 * 1/2004 Reiter ..... H01F 7/0263 24/303
2005/0170739 A1 * 8/2005 Zoellner ..... A63H 33/046 446/92
2006/0111010 A1 * 5/2006 Park ..... A63H 33/046 446/92
2009/0133342 A1 5/2009 Copeland
2013/0112355 A1 * 5/2013 Roth ..... A47H 23/00 160/127
2014/0227934 A1 * 8/2014 Rudisill ..... A63H 33/046 446/92
2014/0256210 A1 * 9/2014 Johnson ..... A63H 33/048 446/108
2015/0072587 A1 * 3/2015 Ornstein ..... A63H 33/046 446/92
2015/0104993 A1 * 4/2015 Kennedy ..... A63H 33/10 446/108
2016/0184727 A1 * 6/2016 Ornstein ..... A63H 33/046 446/92
2017/0036133 A1 * 2/2017 Moffett ..... A63H 33/044

FOREIGN PATENT DOCUMENTS

CA 2670298 A1 5/2008
CA 2692560 A1 1/2009

OTHER PUBLICATIONS

PowerCiix, online: http://www.guidecraft.com/products/633637.
Soft Foam Magnets, online: http://www.learningresources.com/product/soft+foam+magnetic+rainbow+fraction--174-+tiles.do#.
MetroMags, online: http://www.amazon.com/Metro-Mags-Clear-Colors-Piece/dp/B00A29U2TS Admitted Prior Art (Undated).
Moonish, online: http://www.moonishco.com/.
Mosaic Geometric self-adhesive foam shapes, Oriental Trading Company, reviewed Aug. 5, 2010, [online], [retrieved on May 16, 2015] Retrieved from Google search.
Non-Final Rejection dated May 28, 2015 for related U.S. Appl. No. 14/055,333.
Foam Fun!, online: http://www.amazon.com/Foam-Fun-Magnets-Pattern-Biocks/dp/80015KGFQM.
Fractiles, online: http://www.fractiles.com/.
Kvadratclouds.com, "Clouds, Unique Design, Uniquely You—Designed by Ronan and Erwan Bouroullec, Presented by Kvadrat". (2009) Retrieved from http://web.archive.org/web/20090119080742/http://www.kvadratclouds.com/, on Jul. 22, 2015.
Imaginarium, online: http://www.imaginarium.ie/magnetic-construction-pieces-50065.htm.
Magformers, online: http://www.mastermindtoys.com/Magformers.aspx.
Magna-Tiles, online: http://www.magnatiles.com/.
Magnetic Art, online: http://www.educationalinsights.com/product/magnetic+art.do.

* cited by examiner

MODULAR CONSTRUCTION PANELS AND FASTENERS THEREFOR

FIELD

The following relates generally to construction panels, and more particularly to modular construction panels and fasteners for connecting modular construction panels.

BACKGROUND

A toy construction set may include a set of blocks or panels which can be connected or combined to assemble larger structures. Some construction sets may include a number of identical construction units with various connection points to be combined in a variety of different ways. Other construction sets may include specific construction units which are meant to connect with other construction units in a limited number of prescribed configurations. The units of a construction set may be connected by a connecting mechanism such as hook-and-loop fasteners or interlocking pegs and holes.

SUMMARY

According to a first aspect of the specification, a unit for a modular construction set includes a panel having a front surface and a back surface opposite the front surface. The panel is made of a flexible material that biases the panel to a flat state. The panel includes an aperture between the front surface and the back surface. The unit further includes a fastener affixed to the panel at the aperture, the fastener including a first piece and a second piece joinable to the first piece through the aperture to affix the fastener to the panel. The fastener further includes a magnet disposed between the first piece and the second piece to engage the fastener with an oppositely facing fastener of the modular construction set.

According to another aspect of the specification, a modular construction set includes a plurality of such units.

According to yet another aspect of the specification, the fastener includes a first piece including a first outer portion and a first retaining wall projecting inward from the first outer portion to define an inner space. The fastener further includes a second piece joinable to the first piece through an aperture of a panel of a unit of the modular construction set to affix the fastener to the panel. The second piece includes a second outer portion and a second retaining wall projecting from the second outer portion. The second retaining wall is to engage with the first retaining wall to join the first piece and the second piece together. The fastener further includes a magnet disposed between the first piece and the second piece to engage the fastener with another fastener of the modular construction set.

DETAILED DESCRIPTION

A unit for a modular construction set may include a panel and one or more magnets embedded within the panel. These magnets may be attracted to other magnets of the proper polarity embedded within other panels, and thus, the panels may be releasably connected by magnetic attraction to assemble larger structures.

Although useful for assembling larger structures, having a magnet embedded in such a panel may pose manufacturing challenges and limit the modularity and design choices available to manufacturers and users of such panels. For example, embedding a magnet in a panel generally involves sandwiching the magnet between two or more layers of material or disposing the magnet within a specialized pocket built into the panel. These techniques not only add material to the panel, but also add manufacturing steps. Further, a magnet embedded in such a way is generally secured in place by stitching between layers of the panel, adhering the magnet to inner surfaces of the panel, or by sizing pockets to snuggly retain the magnet. Moreover, once manufactured, such magnets are generally not easily removable or replaceable by the user. Further, such magnets may be unknowingly dislodged from such layers of material due to wear and tear.

A unit for a modular construction set may be provided which includes a panel and a fastener containing a magnetic which is affixed to the panel by joining together two pieces of the fastener through an aperture in the panel. Different units may be assembled together via the magnetic attraction between fasteners. Such a unit may be manufactured from a single sheet of material without the need for additional layers or pockets to contain a magnet. Since the unit may be formed from a single sheet of material, manufacturing is simplified. Further, since the fastener is not embedded within the panel, the fastener may be replaced with other fasteners of different visual appearance, magnetic strength or polarity, or removed altogether. Thus, a panel may be made customizable in visible appearance and functionality by the manufacturer and the end user. Further, such a fastener is less prone to being unknowingly dislodged from the unit. Rather, such a fastener missing from a unit would be easily noticeable, thereby reducing the risk that a dislodged fastener may unknowingly cause a safety concern.

Figure 1:
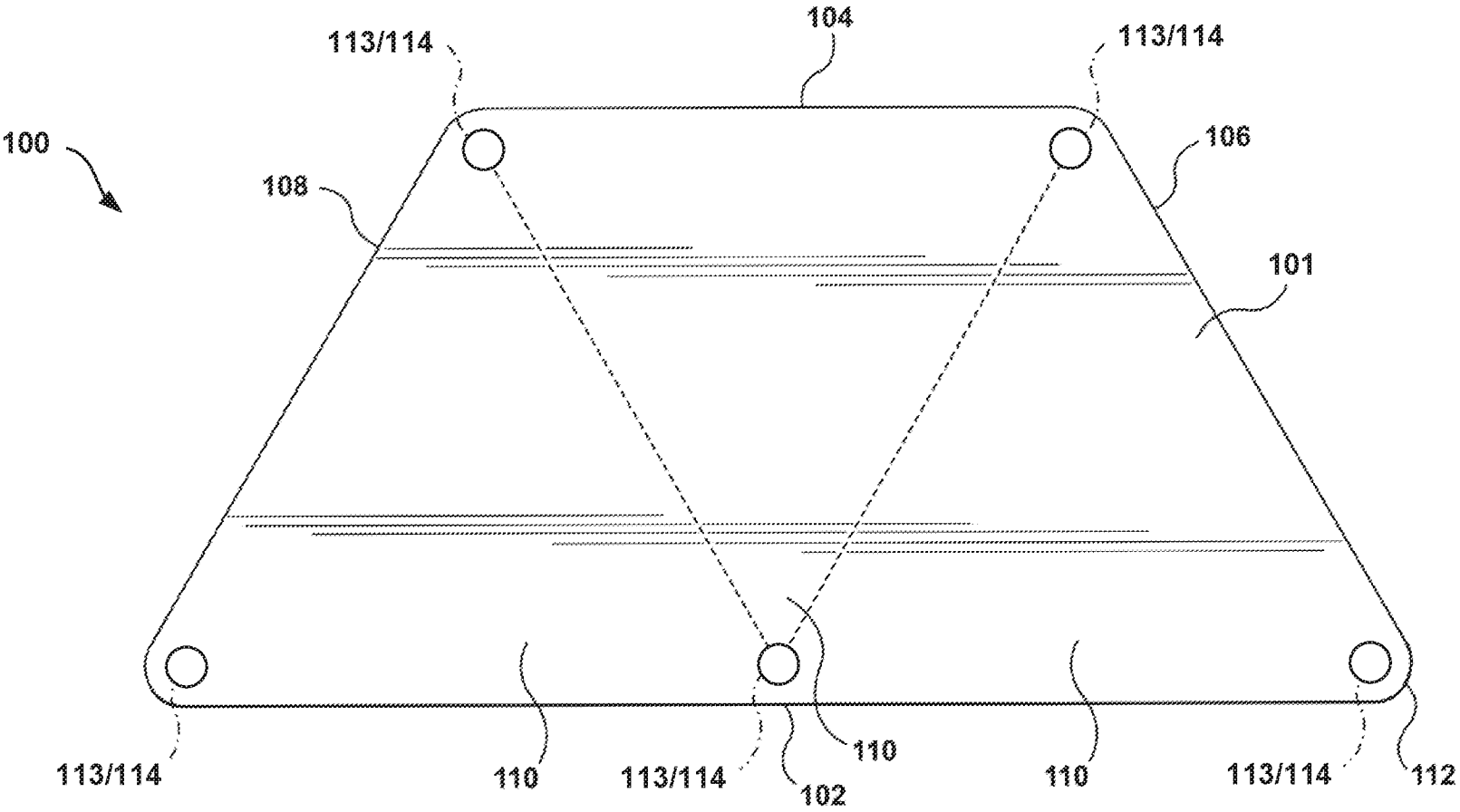
FIG. 1 is a top plan view of an example unit of a modular construction set.

FIG. 1 shows an example unit 100 of a modular construction set. The unit 100 includes a panel 101 and a plurality of fasteners 114. The panel 101 is made of a flexible material able that biases the panel 101 to a flat state. The flexible material may allow the panel 101 to be flexed in any direction.

The panel 101 has a front surface and a back surface opposite the front surface. Further, the panel 101 includes a plurality of holes or apertures 113 between the front surface and the back surface. A fastener 114 may be fixed to the panel 101 at one or more of the apertures 113, as discussed herein. The fasteners 114 may be engaged with other fasteners 114 of the same unit 100 or of other units 100 to build toys, structures, clothes, decorations, and the like from one or more units 100.

Each fastener 114 may include a magnet disposed or contained therein to engage a fastener 114 with an oppositely facing fastener 114 of the unit 100 or of another unit 100 of the modular construction set. Thus, each fastener 114 may engage with another fastener 114 by magnetic attraction. In some examples, each of the magnets in a unit 100 may be oriented in the same direction in relation to the front surface and the back surface of the panel 101. That is, the north poles of all magnets face one surface while the south poles of all magnets face the other surface. In such examples, a front-facing side of a fastener 114 may engage with a backward-facing side of a fastener 114 of the same unit 100 or of another unit 100. In other examples, the magnets may be disposed such that the poles alternate or in another predetermined manner.

Engaging two oppositely facing fasteners 114 may form a lap joint in which the front surface of the panel 101 of a first unit 100 is releasably held to either the back surface or the front surface of a panel 101. For example, as shown in FIG. 5H, a lap joint is formed using a single unit 100. As another example shown in FIG. 2, a lap joint is formed using two adjacent units 100.

The panel 101 may have a substantially trapezoidal shape, and in particular, a substantially isosceles trapezoidal (trapezium) shape. In the example shown, the panel 101 is an isosceles trapezoid having a longer base 102 which is approximately twice the length of a shorter base 104, and having legs 106, 108 (the non-parallel sides) which are of substantially equal length to the shorter base 104, such that the legs 106, 108 extend from the longer base 102 at an angle of approximately sixty degrees, and the trapezoid essentially comprises three equivalently sized adjacent equilateral triangles 110. It will be appreciated that the trapezoid shown in FIG. 1 has rounded corners 112, for safety and aesthetic purposes, but is substantially trapezoidal in shape.

In the example shown, the unit 100 includes five fasteners 114 affixed within five apertures 113 evenly spaced at discrete locations around at the perimeter of the panel 101. Thus, the fasteners 114 are disposed such that each fastener 114 is adjacent to at least two equidistantly spaced apart other fasteners 114, and each pair of adjacent fasteners 114 is positioned to engage with a pair of adjacent fasteners 114 of another unit of the modular construction set, thereby forming a lap joint. Further, the fasteners 114 are shown disposed proximate the four corners of the panel 101 with a fifth fastener 114 disposed midway between the two fasteners 114 along the longer base 102 of the panel 101. It can therefore be appreciated that the five fasteners 114 essentially form vertices of the three equivalently sized equilateral triangles 110.

The panel 101 may be formed of a single layer of a flexible material able to be flexed in any direction and that allows the panel 101 to flex and biases the panel 101 to a flat state. The flexible material may have rigidity sufficient to form a self-supporting structure by combination of the unit 100 with another other unit 100.

In some examples, the panel 101 may be formed of a plurality of layers, each layer having apertures 113 therethrough. For example, the panel 101 may include two surface layers and an internal layer. The two surface layers may define the front surface and the back surface of the panel 101. The two surface layers may comprise similar materials which may be soft and suitable for a toy. The surface layers may include a non-woven felted material that is soft to the touch. The surface layers may include wool blends, synthetic polymers, polyester, polyurethane, polyester/polyurethane blends, vinyl, coconut, foams, or non-woven and woven materials. Surface layers of a synthetic polymer may enable the panel 101 to be easily cleaned and wiped for sanitary purposes. The internal layer may be of a flexible material, such as a thin plastic or other flexible material that flexes but is biased to a flat state. The internal layer may provide sufficient rigidity to the panel 101 to form a self-supporting structure by combination of the unit 100 with another other unit 100. The different layers may be held together to mitigate the different layers from shifting with respect to one another or separating from one another. For example, the layers may be laminated, ultrasonically welded, fused, glued or stitched together. Stitches may be added anywhere on the panel 101, such as around a perimeter of the panel 101, in an aesthetically pleasing pattern for both rigidity and appearance.

Figure 8A:
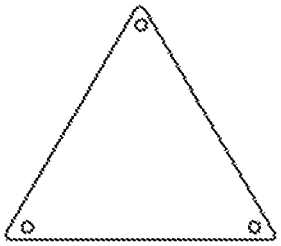
FIG. 8A illustrates an example shape of a panel of a unit of a modular construction set.
Figure 8B:
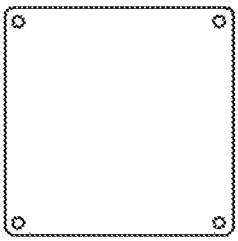
FIG. 8B illustrates another example shape of a panel of a unit of a modular construction set.
Figure 8C:
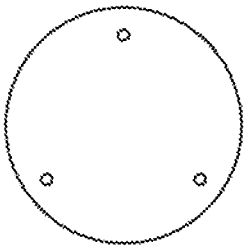
FIG. 8C illustrates yet another example shape of a panel of a unit of a modular construction set.
Figure 8D:
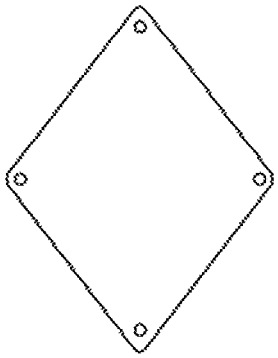
FIG. 8D illustrates yet another example shape of a panel of a unit of a modular construction set.
Figure 8E:
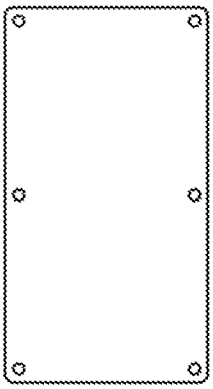
FIG. 8E illustrates yet another example shape of a panel of a unit of a modular construction set.
Figure 8F:
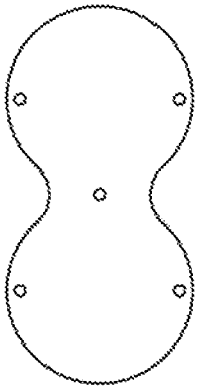
FIG. 8F illustrates yet another example shape of a panel of a unit of a modular construction set.
Figure 8G:
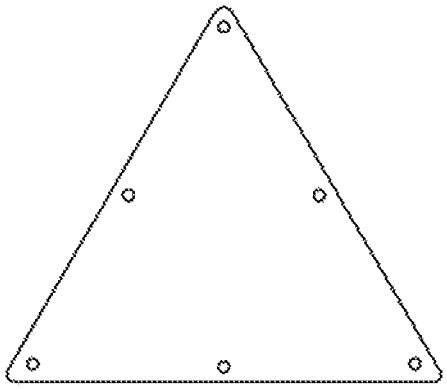
FIG. 8G illustrates yet another example shape of a panel of a unit of a modular construction set.
Figure 8H:
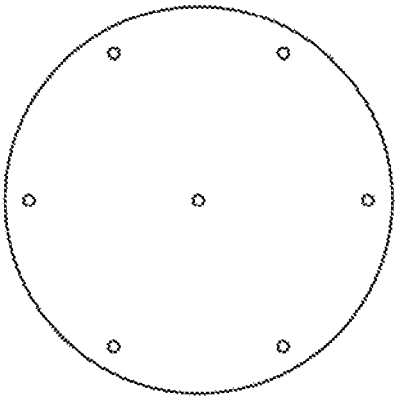
FIG. 8H illustrates yet another example shape of a panel of a unit of a modular construction set.
Figure 8I:
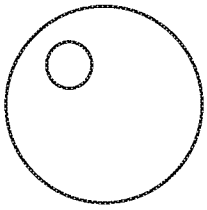
FIG. 8I illustrates yet another example shape of a panel of a unit of a modular construction set.

Although a unit 100 having a plurality of apertures 113 and a plurality of fasteners 114 is shown, it is to be understood that a unit 100 may include only a single aperture 113 and a single fastener 114 affixed thereto, such as, for example, as shown in FIG. 8I.

Figure 2:
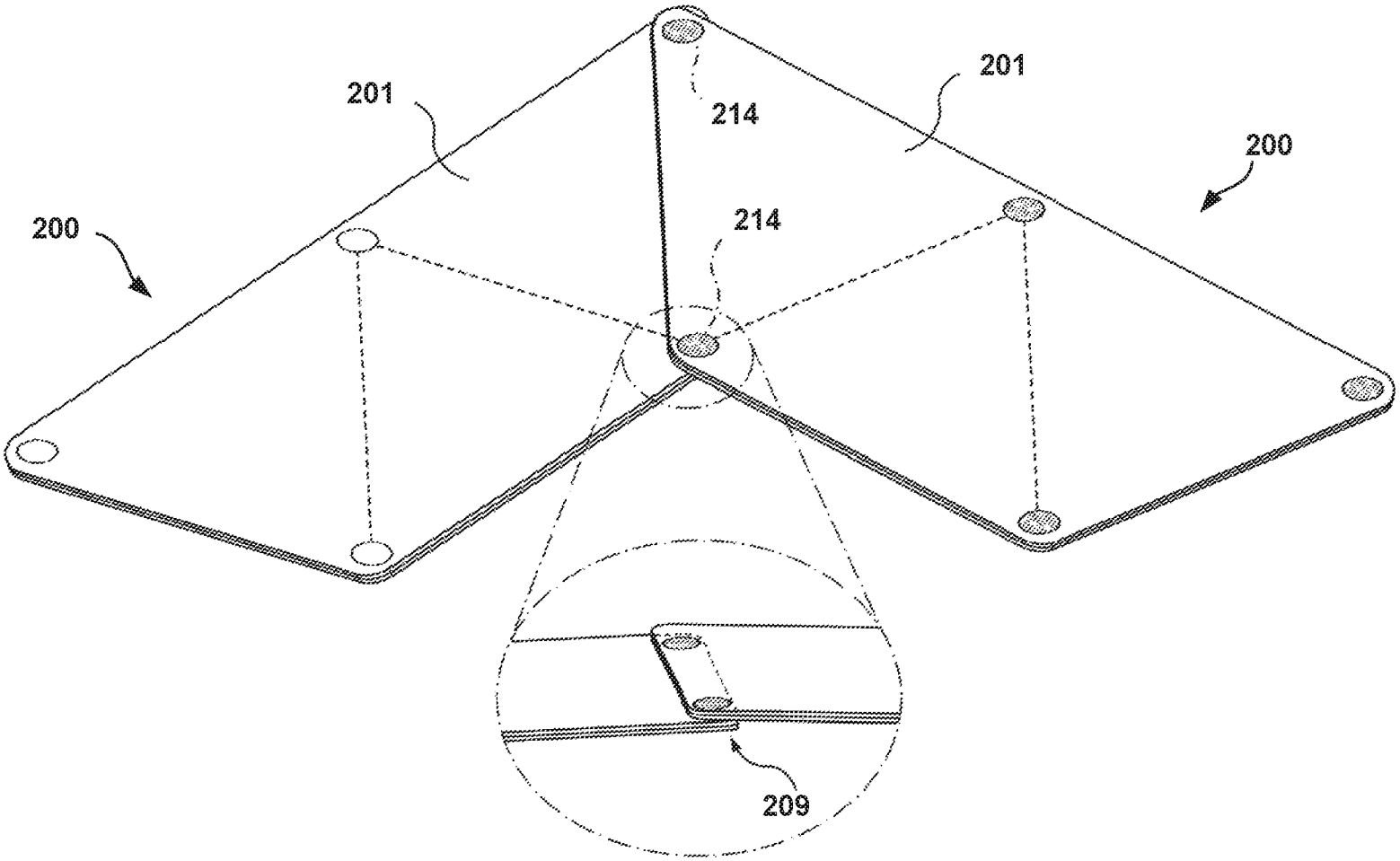
FIG. 2 is a perspective view illustrating a lap joint made by two example units of a modular construction set.

FIG. 2 illustrates two units 200 of a modular construction set joined to form a lap joint 209. That is, the panel 201 of a first unit 200 is adjoined to the panel 201 of another unit 200 by overlapping the fasteners 214 of the two units 200. It will be appreciated that the use of the lap joint 209 along with the evenly spaced positioning of the fasteners 214 permits a high number of permutations for adjoining two units 200, since, for example, two, three, four or five adjacent fasteners 214 of one unit 200 could be adjoined to any two adjacent fasteners 214 of the other unit 200.

Figure 3A:
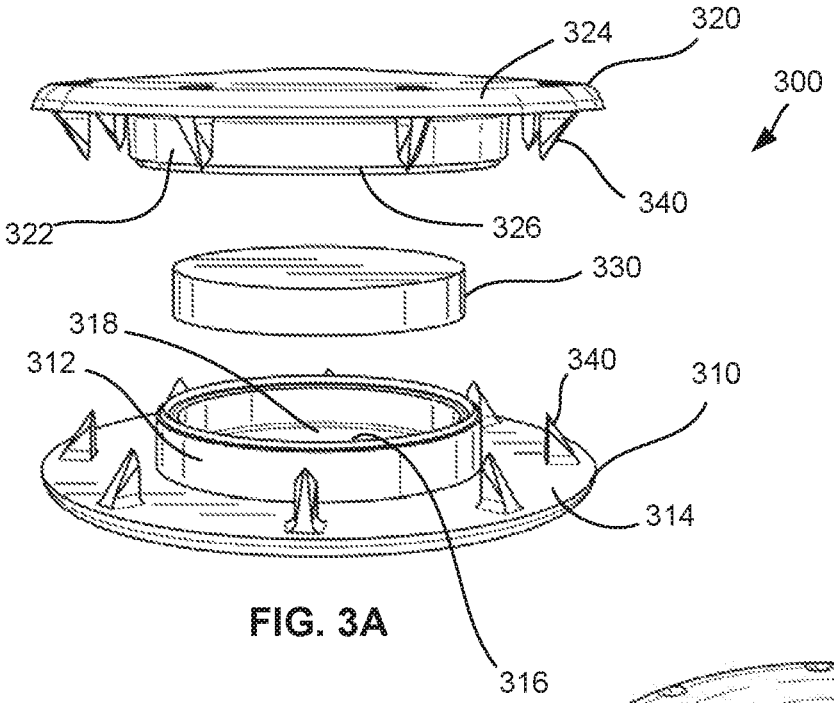
FIG. 3A is a close-up exploded view of an example fastener of a unit of a modular construction set.
Figure 3B:
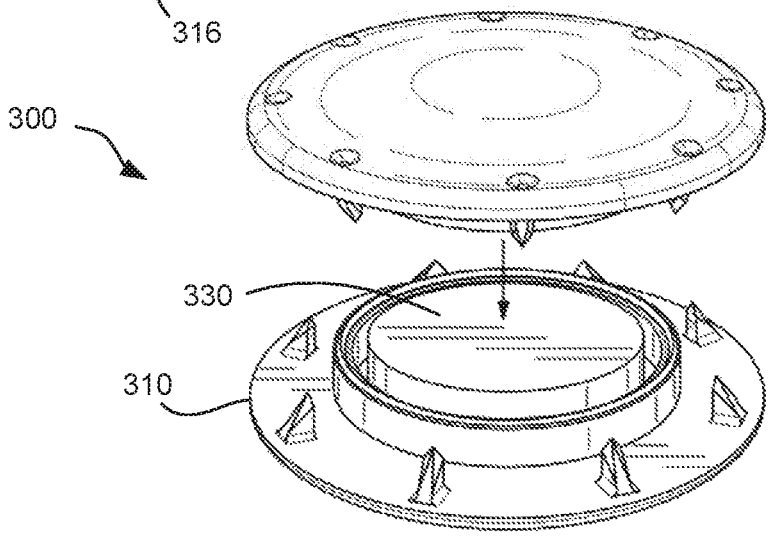
FIG. 3B is another close-up exploded view of the example fastener of FIG. 3A showing a magnet seated in one piece of the fastener.
Figure 3C:
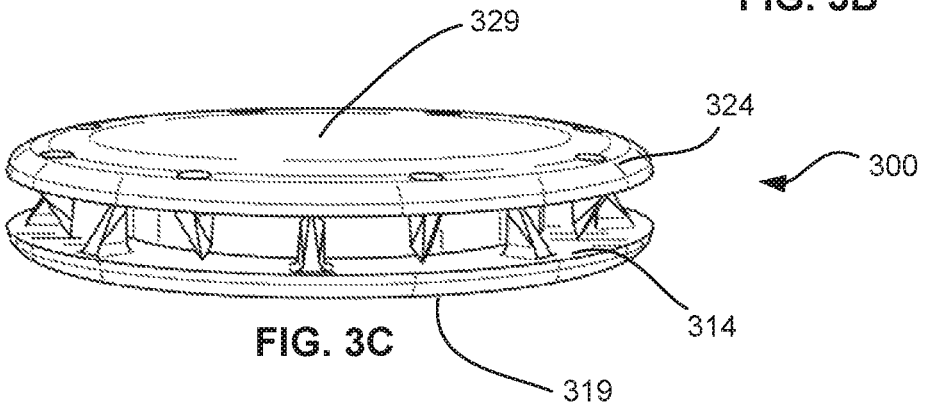
FIG. 3C is a close-up side perspective view of the example fastener of FIG. 3A showing two pieces of the fastener joined together.

FIGS. 3A-3C show example fastener 300 in greater detail. As shown in FIG. 3A, the fastener 300 includes a first piece 310 and a second piece 320. The first piece 310 and the second piece 320 are joinable through an aperture of a panel to affix the fastener to the panel. When joined, a retaining force provided by the first piece 310 and the second piece 320 around the rim of the aperture retains the fastener to the panel.

Further, the fastener 300 includes a magnet 330 between the first piece and the second piece 320. When joined, the first piece 310 and the second piece 320 retain the magnet 330 therein. The magnet 330 may be initially joined to, or seated in, one of the pieces 310, 320, as shown for example in FIG. 3B, prior to joinder of the first piece 310 to the second piece 320. The magnet 330 may provide a magnetic force to attract the fastener 300 to other fasteners 300 of the same unit or another unit thereby allowing the unit to be used to build toys, structures, clothes, decorations, and the like.

The first piece 310 includes an inner portion 312 and an outer portion 314. Similarly the second piece 320 includes an inner portion 322 and an outer portion 324.

The inner portions 312, 322 may be sized to be insertable through the aperture. Further, the inner portions 312, 322, may be complementary shaped to fit together and to retain the magnet 330 between them.

In some examples, the inner portions 312, 322 may be releasably joinable. Further, the inner portions 312, 322 may be releasably joinable by releasable snap fitting. Thus, fasteners 300 may be replaced with other fasteners 300 or removed altogether, thereby enabling greater flexibility for a unit to be designed or modified with different magnets 330 or fasteners 300. For example, a fastener 300 may be swapped for another fastener which is of different visual appearance (e.g. color, texture) or different function (e.g. different magnet strength, orientation). Further, where the inner portions 312, 322 are releasably joinable, the inner portions 312, 322 may be designed to be released only by use of a particular tool. Thus, such modification of the unit may be limited to adults or licensed professionals with access to the particular tool, limiting the risk that a fastener 300 will be removed from a panel without proper supervision.

In other examples, the inner portions 312, 322 may be permanently joined, such as, for example, by permanent snap fitting, an adhesive or ultrasonic welding for long-term installation. Thus, a fastener 300 may be securely fixed to a panel to further ensure safety.

The outer portions 314, 324 may be sized to cover the aperture. For example, the outer portions 314, 324 may have respective widths greater than a width of the aperture, and the inner portions 312 may have respective widths less than the width of the aperture. The outer portions 314, 324, may completely cover the aperture. By joining the first piece 310 and the second piece 320 through an aperture, the first piece 310 may cover the aperture from one side of the panel, and the second piece 320 may cover the aperture from the other side of the panel. The outer portions 314, 324, may be substantially similarly shaped to provide a uniform look and feel to both sides of the unit. The outer portions 314, 324, may be differently colored or textured to provide a different visual appearance to opposite sides of the unit.

The inner portion 312 of the first piece 310 may include a first retaining wall 316 projecting inward from the outer portion 314 of the first piece 310. The first retaining wall 316 of the first piece 310 and the outer portion 314 of the first piece 310 thereby defines an inner space 318 to retain the magnet 330. As shown in FIG. 3B, the magnet 330 may be seated in the inner space 318 prior to joinder of the first piece 310 with the second piece 320. The magnet 330 may be permanently joined to the first piece 310 within the inner space 318, such as by adhesive, or may be removable from the inner space 318. Further, the inner portion 322 of the second piece 320 may include a second retaining wall 326 projecting inward from the outer portion 324 of the second piece 320. The second retaining wall 326 is to engage with the first retaining wall 316 to join the first piece 310 and the second piece 320 together. Joinder of the first retaining wall 316 with the second retaining wall 326 may be reversible. Joinder of the first retaining wall 316 and the second retaining wall 326 may be by snap fitting.

As can be seen with reference to FIG. 3C, the outer portion 314 of the first piece 310 includes a first outer face 319 and the outer portion 324 of the second piece 320 includes a second outer face 329. When the fastener 300 is affixed to a panel, the first outer face 319 may be oriented according to a same facing as the front surface of the panel and the second outer face 329 may be oriented according to a same facing as the back surface of the panel. The outer faces 319, 329 may be cover the aperture and may be substantially flush with the surfaces of the panel. Further, the outer faces 319, 329, may slightly protrude from the surface of the panel. For example, the outer faces 319, 329 may be rounded or inclined to protrude outward.

One or both of the pieces 310, 320 may include spikes or teeth 340 to secure the piece 310, 320 to the panel. These teeth 340 may protrude inwardly from the lip or inward-facing surface of the outer portions 314, 324. When the fastener 300 is affixed to a panel, these teeth 340 may impinge on the material of the panel to secure the fastener 300 in position. In other words, the teeth 340 dig into the front or back surfaces of the panel and to anchor the fastener 300 in place. The teeth 340 may thereby mitigate rotational or lateral motion of the fastener 300 with respect to the panel. In examples in which both of the pieces 310, 320 include teeth 340, the teeth 340 of one piece may be interposed between or interlock with the teeth 340 of the other piece, as shown in FIG. 3C, thereby enabling the teeth 340 to dig deeply into the panel, even when the pieces 310, 320 are completely joined together.

In some examples, the teeth 340 may puncture the material of the panel. If the teeth 340 puncture the material of the panel, the teeth 340 may not protrude entirely through the material. In other examples, the teeth 340 may not puncture the material, but merely depress the material at points of contact.

Figure 4A:
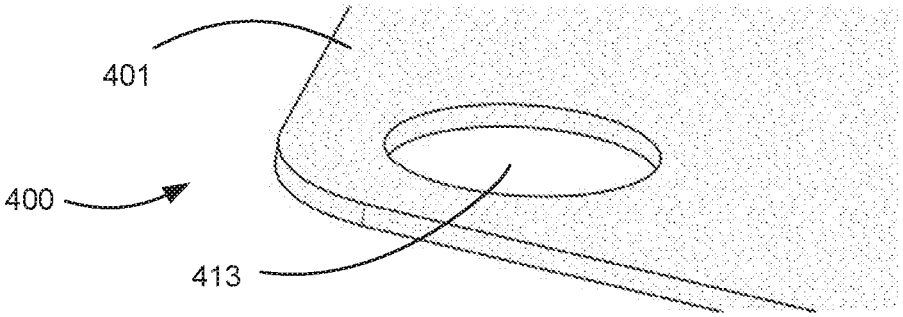
FIG. 4A is a dose-up perspective view of an example unit of a modular construction set having an aperture.
Figure 4B:
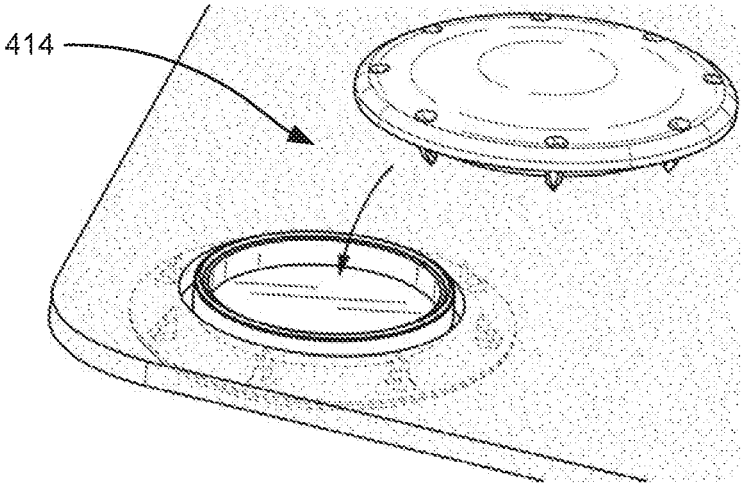
FIG. 4B is a close-up perspective view illustrating the fixation of an example fastener to the unit of FIG. 4A through the aperture of the unit.
Figure 4C:
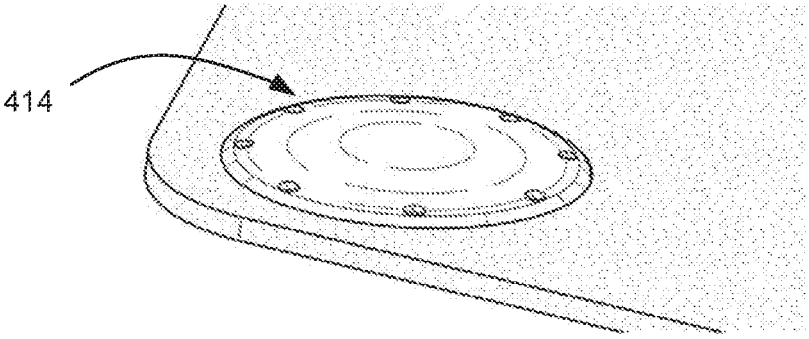
FIG. 4C is a close-up perspective view of the fastener of FIG. 4B fixed to the unit at the aperture.

FIGS. 4A-4C illustrate the fixation of an example fastener 414 to a panel 401 of a unit 400 of a modular construction set. In FIG. 4A, the panel 401 includes and empty aperture 413. In FIG. 4B, the panel 401 is shown with an inner portion of a first piece of the fastener 414 inserted through a back surface of the panel 401, and a second piece of the fastener 414 ready to be joined with the first piece. A magnet is not shown, however, it is to be understood that a magnet may be disposed within the first piece or the second piece of the fastener 414 as discussed herein. In FIG. 4C, the second piece of the fastener 414 is joined to the first piece, and both the first piece and the second piece of the fastener are joined through the aperture 413 of the panel 401.

The fastener 414 may slightly protrude from the surface of the panel 401. For example, a piece of the fastener 414 may include an outer portion having a rounded or inclined outer face. This rounded or inclined outer face may gradually protrude outward from the rim of the aperture 413 when the fastener 414 is joined through the aperture 413. The fastener 414 may thereby gradually and smoothly protrude from the surface of the panel 401.

When a fastener 414 slightly protrudes from the surface of a panel 401, the unit 400 may more easily be engaged with other units 400. Further, a unit 400 may more easily swivel or rotate when engaged with another unit 400 via another fastener 414. Thus, a slightly protruding fastener 414 may serve as a pivot point about which two units 400 may be easily swiveled or rotated.

Referring now to FIGS. 5A to 5H, exemplary structures each comprising a plurality of panels are shown. Various exemplary structures are shown, though other structures could be formed, limited only by the creativity of the individual creating the structures. In the examples shown, adjoining units are fastened by forming a lap joint by overlapping portions of the panels of the units and mating one or more of the fasteners of each unit. It will be appreciated that a more rigid attachment may be accomplished by mating a plurality of fasteners of adjoining unit, however more creative structures may be possible by mating just one fastener of adjoining panels.

Figure 5A:
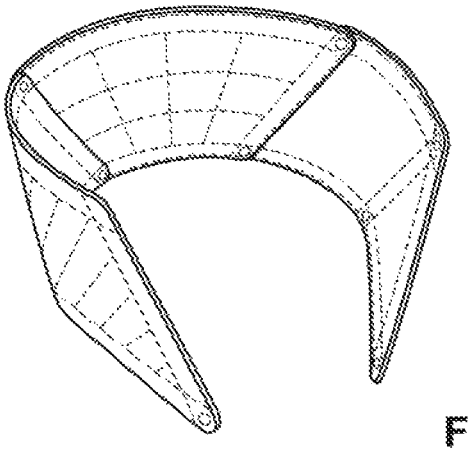
FIG. 5A illustrates an example structure assembled from units of a modular construction set.
Figure 5B:
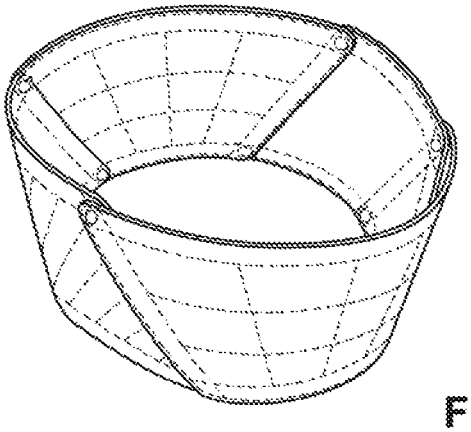
FIG. 5B illustrates another example structure assembled from units of a modular construction set.
Figure 5C:
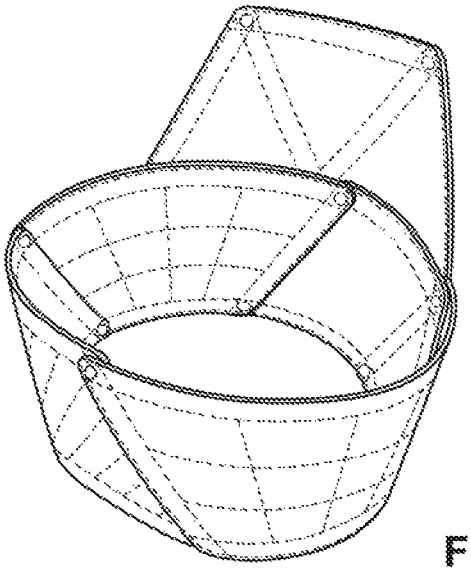
FIG. 5C illustrates yet another example structure assembled from units of a modular construction set.

In FIG. 5A, a structure of three units is shown. In this example, the three units face identically shaped panels wherein a lap joint is formed between adjacent units using two fasteners along a leg of the panels. In FIG. 5B, a structure of four units is shown, wherein a unit is added to the structure of FIG. 5A. Similar to the structure of FIG. 5A, the units have identically shaped panels wherein a lap joint is formed between adjacent units using two fasteners along a leg of the panels. In FIG. 5C, a structure of five units is shown, wherein a unit additional to the structure of FIG. 5B is adjoined to two of the units previously used.

Figure 5D:
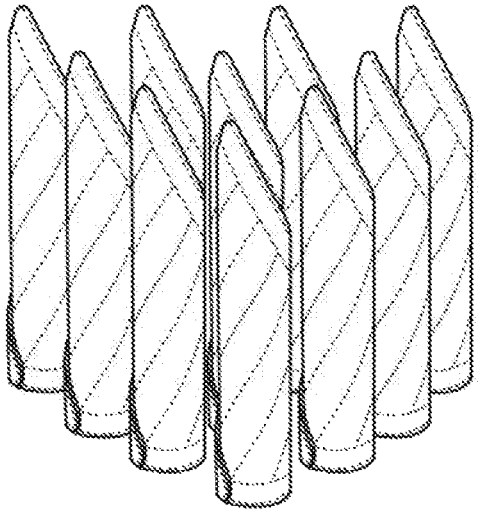
FIG. 5D illustrates a group of example structures assembled from units of a modular construction set.
Figure 5E:
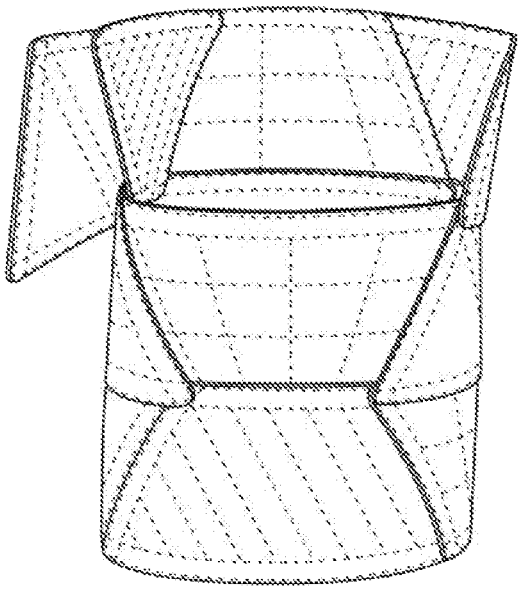
FIG. 5E illustrates yet another example structure assembled from units of a modular construction set.
Figure 5F:
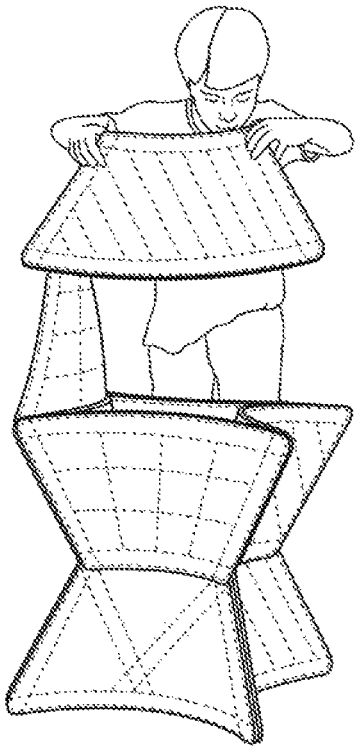
FIG. 5F illustrates yet another example structure assembled from units of a modular construction set.
Figure 5G:
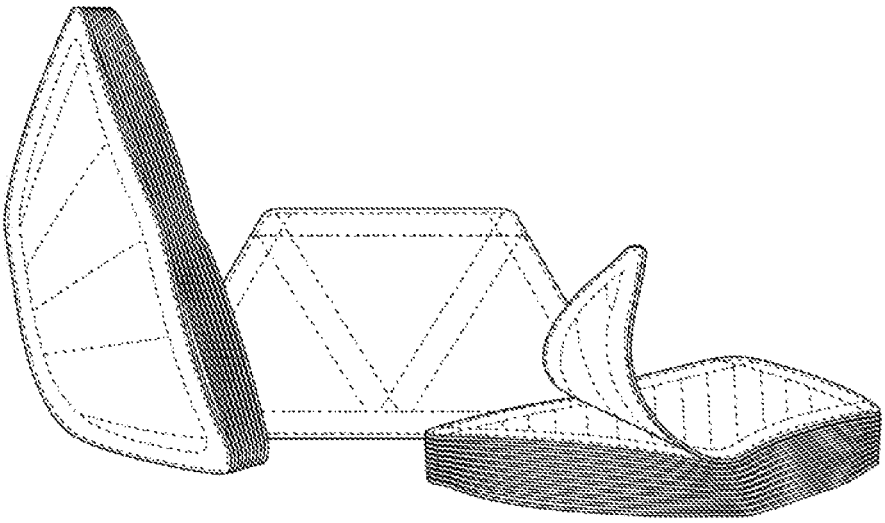
FIG. 5G illustrates example stacks of units of a modular construction set.
Figure 5H:
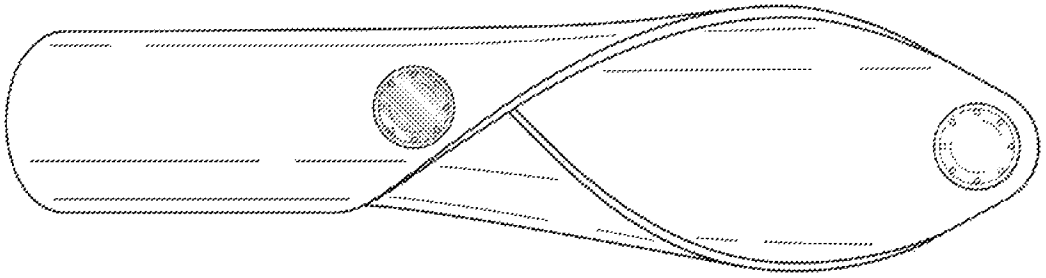
FIG. 5H illustrates yet another example structure assembled from a unit of a modular construction set.

FIG. 5D shows an example where a unit is engaged with itself to form a tubular structure, which is shown as freestanding. FIG. 5E shows a freestanding cylindrical enclosure formed by a plurality of units and FIG. 5F shows another freestanding enclosure. FIG. 5G shows an example where a plurality of units are stacked one upon another. FIG. 5H shows another example where a unit is engaged with itself to form a tubular structure, where the front surface of the panel is shown to display fasteners of a different color, shade, or visual appearance, than fasteners on the back surface of the panel.

Figure 6A:
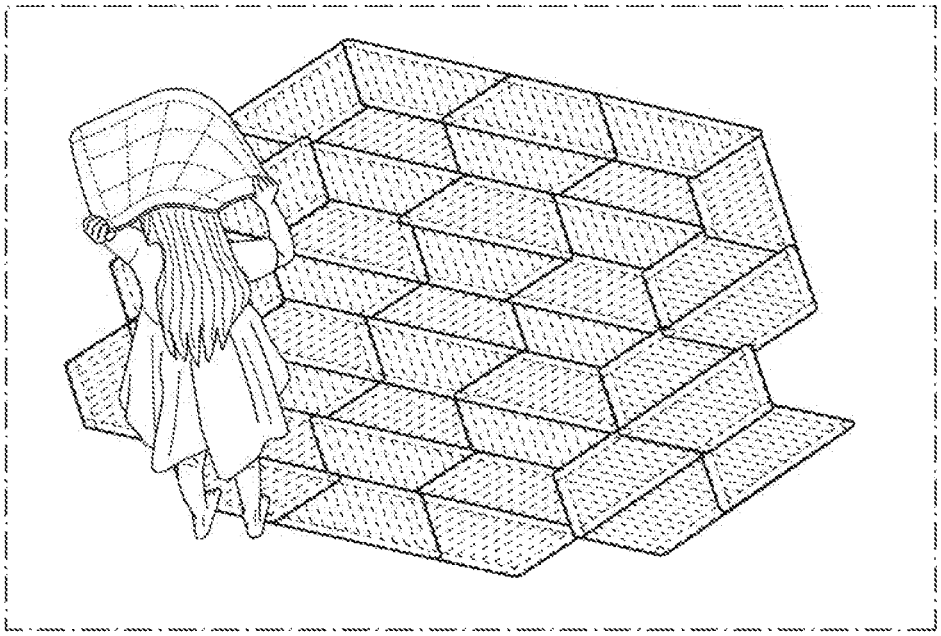
FIG. 6A illustrates yet another example structure assembled from units of a modular construction set.
Figure 6B:
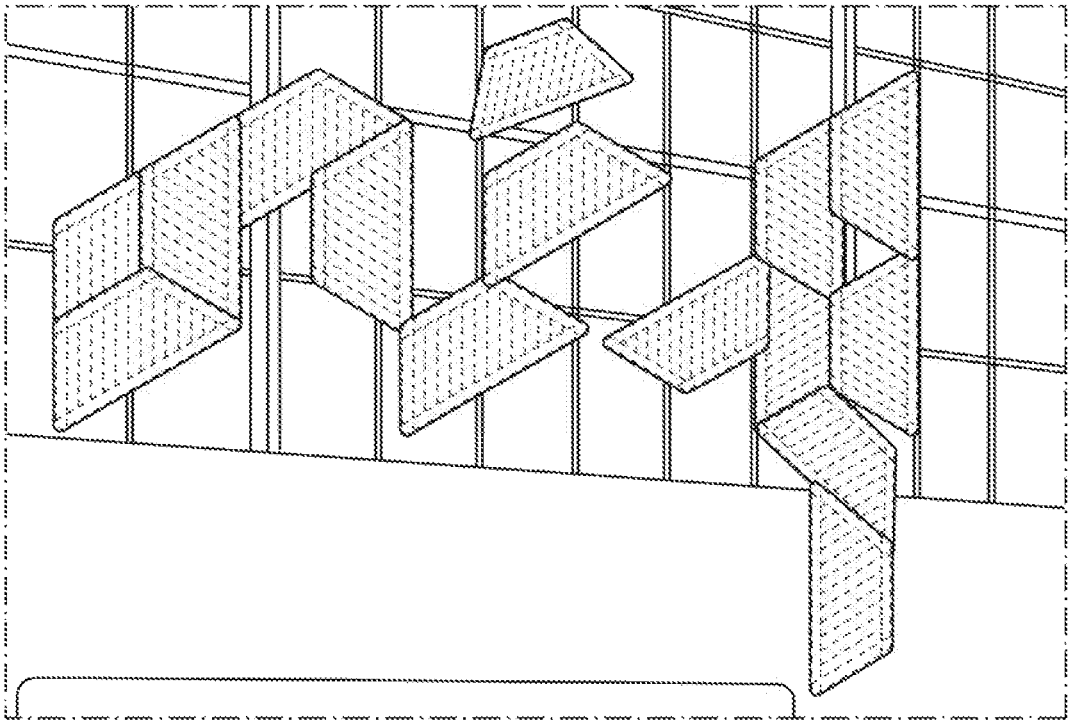
FIG. 6B illustrates further example structures assembled from units of a modular construction set.

FIGS. 6A and 6B shows various two-dimensional structures. FIG. 6A shows an example where the units are joined to form a two dimensional flooring structure. FIG. 6B shows another two dimensional example of a window covering, which is further held against a window by magnetic bond to a metallic window frame.

Figure 7A:
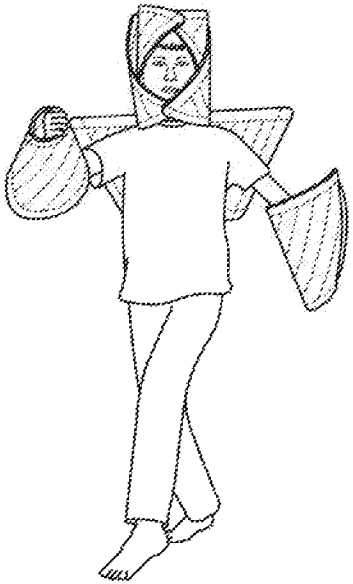
FIG. 7A illustrates an example set of clothing or costume assembled from units of a modular construction set.
Figure 7B:
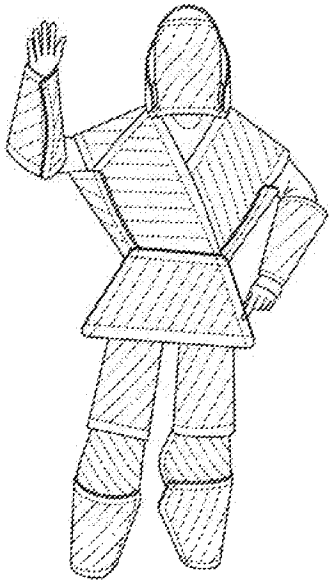
FIG. 7B illustrates another example set of clothing or costume assembled from units of a modular construction set.
Figure 7C:
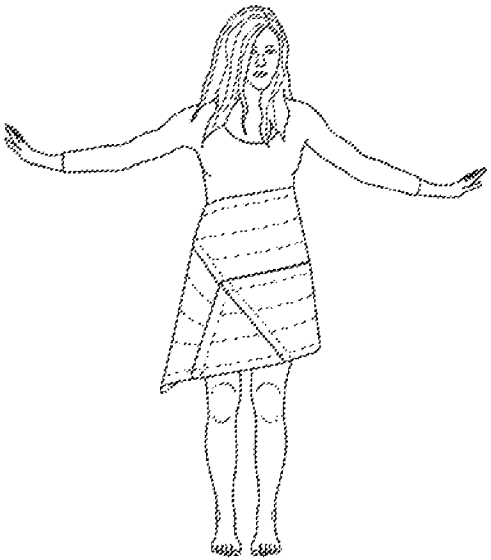
FIG. 7C illustrates yet another example set of clothing or costume assembled from units of a modular construction set.

FIGS. 7A to 7C shows various costume or clothing structures that could be created, including a helmet and sleeves in FIG. 7A, full body armor costume in FIG. 7B and a skirt in FIG. 7C.

As the units are flexible, some or all of the units can be held in a flexed position to increase the number of structures that can be created.

Figure 8J:
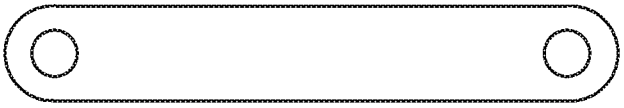
FIG. 8J illustrates yet another example shape of a panel of a unit of a modular construction set.
Figure 8K:
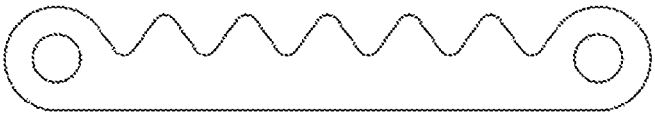
FIG. 8K illustrates yet another example shape of a panel of a unit of a modular construction set.

Referring now to FIGS. 8A to 8K, other units having other panel shapes are shown, although further shapes may be provided. The panels shown in FIGS. 8A to 8H are generally symmetrical about an axis, though irregular shapes could also be used. For generally symmetrical panels, it is more easily understood to position the fasteners in such a manner that they are evenly spaced apart. FIG. 8A shows a triangular unit. The unit may have three fasteners proximate the vertices of the triangle, though other approaches are possible, such as by placing an additional fastener intermediate each fastener shown, as seen in FIG. 8G, and additionally another fastener may be disposed at the center of the triangle. FIG. 8B shows a square unit which, in this example, has four fasteners at its corners though, again, other approaches are possible. FIG. 8C shows a circular unit having three equidistant fasteners, though additional fasteners may be disposed around the perimeter of the circle and at its center, as shown in FIG. 8H. FIG. 8D shows a diamond shaped unit having four fasteners at its corners. FIG. 8E shows a rectangular unit having six fasteners. FIG. 8F shows an irregularly shaped dual part-circular unit having five fasteners. FIG. 8I shows a circular unit having one fastener. FIG. 8J shows an elongated unit having rounded ends with a fastener at either end. FIG. 8K shows an elongated unit having a toothed edge, a straight edge opposite the toothed side, and rounded ends, and having a fastener at either end.

Thus, modular construction sets, units for the modular construction sets, and fasteners for the units, are provided. The herein described units may be useful for modular building components for constructing toys, structures, costumes, clothing, living room objects, carpets, wall art, sculptures, furniture, and window blinds, modular building components for dividing space, modular building components used for sound absorption, and modular building components for constructing home décor accessories.

It should be recognized that features and aspects of the various examples provided above can be combined into further examples that also fall within the scope of the present disclosure. In addition, the figures are not to scale and may have size and shape exaggerated for illustrative purposes. The scope of the claims should not be limited by the above examples, but should be given the broadest interpretation consistent with the description as a whole.

The invention claimed is:

1. A unit for a modular construction set, the unit comprising:

a panel having a front surface and a back surface opposite the front surface, the panel being made of a flexible material that biases the panel to a flat state, the panel including an aperture between the front surface and the back surface; and a fastener affixed to the panel at the aperture, the fastener including a first piece and a second piece joinable to the first piece through the aperture to affix the fastener to the panel, and a magnet disposed between the first piece and the second piece to engage the fastener with an oppositely facing fastener of the modular construction set;

wherein the first piece of the fastener includes an inner portion and an outer portion, the second piece includes an inner portion and an outer portion, the outer portions each being sized to cover the aperture and being substantially flush with the front or back surface of the panel, the inner portions each being sized to be insertable through the aperture.

2. The unit of claim 1, wherein the inner portions are releasably joinable.

3. The unit of claim 1, wherein the inner portions are releasably joinable by releasable snap fitting.

4. The unit of claim 1, wherein the inner portions are joined by ultrasonic welding.

5. The unit of claim 1, wherein the outer portion of the first piece includes a first outer face and the outer portion of the second piece includes a second outer face, the first outer face oriented according to a same facing as the front surface of the panel, the second outer face oriented according to a same facing as the back surface of the panel.

6. The unit of claim 1, wherein the outer portion of the first piece includes a first set of teeth to impinge on the front surface, the outer portion of the second piece includes a second set of teeth to impinge on the back surface, at least some teeth of the second set of teeth interposed between teeth of the first set of teeth.

7. The unit of claim 1, wherein:

the inner portion of the first piece of the fastener comprises a first retaining wall projecting from the outer portion of the first piece, the first retaining wall of the first piece and the outer portion of the first piece defining an inner space;

the inner portion of the second piece of the fastener comprises a second retaining wall projecting from the outer portion of the second piece, the second retaining wall to engage with the first retaining wall to join the first piece and the second piece together; and the fastener comprises a magnet seated in the inner space.

8. The unit of claim 7, wherein the second retaining wall is to snap fit with the first retaining wall to join the first piece to the second piece.

9. The unit of claim 7, wherein the magnet is adhered to at least one of the first piece and the second piece.

10. The unit of claim 1, wherein the first piece or the second piece includes teeth to impinge on the panel to secure the fastener in position onto the panel.

11. The unit of claim 1, wherein the flexible material has rigidity sufficient to form a self-supporting structure by combination of the unit with the other unit.

12. The unit of claim 1, wherein the unit includes a plurality of apertures and a plurality of fasteners, the plurality of apertures evenly spaced at discrete locations around a perimeter of the panel, each aperture of the plurality of apertures having a fastener of the plurality of fasteners affixed within the aperture to form pairs of adjacent fasteners, each pair of adjacent fasteners being positioned to engage with an pair of adjacent fasteners of another unit of the modular construction set.

13. The unit of claim 12, wherein the panel is a substantially trapezoidal panel having a longer base substantially twice a length of a shorter base and two legs extending from the longer base at approximately sixty degrees, and the plurality of fasteners comprises five fasteners affixed substantially at four corners of the substantially trapezoidal panel and midway between two corners of the longer base of the substantially trapezoidal panel.

14. The unit of claim 13, wherein each respective fastener of the plurality of fasteners comprises a respective magnet disposed between the first and second pieces of the respective fastener, all respective magnets having poles oriented in a same direction in relation to the front surface and the back surface.

15. The unit of claim 1, wherein the panel comprises two surface layers, one of the two surface layers defines the front surface and another of the two surface layers defines the back surface, and the two surface layers comprise a non-woven felted material.

16. The unit of claim 15, wherein the panel comprises an internal layer of flexible material disposed between the two surface layers.

17. The unit of claim 1, wherein the panel comprises a synthetic polymer.

18. A modular construction set comprising:

a plurality of units, each unit including:

a panel having a front surface and a back surface opposite the front surface, the panel being made of a flexible material that biases the panel to a flat state, the panel including an aperture between the front surface and the back surface; and a fastener affixed to the panel, the fastener including a first piece and a second piece joinable to the first piece through the aperture to affix the fastener to the panel, and a magnet disposed between the first piece and the second piece to engage the fastener with another fastener of the modular construction set;

wherein the first piece of the fastener includes an inner portion and an outer portion, the second piece includes an inner portion and an outer portion, the outer portions each being sized to cover the aperture and being substantially flush with the front or back surface of the panel, the inner portions each being sized to be insertable through the aperture.

19. A fastener for a modular construction set, the fastener comprising:

a first piece including a first outer portion and a first retaining wall projecting inward from the first outer portion to define an inner space;

a second piece joinable to the first piece through an aperture of a panel of a unit of the modular construction set to affix the fastener to the panel, the second piece including a second outer portion and a second retaining wall projecting from the second outer portion, the second retaining wall to engage with the first retaining wall to join the first piece and the second piece together; and a magnet disposed between the first piece and the second piece to engage the fastener with another fastener of the modular construction set;

wherein the first piece of the fastener includes an inner portion and an outer portion, the second piece includes an inner portion and an outer portion, the outer portions each being sized to cover the aperture and being substantially flush with the front or back surface of the panel, the inner portions each being sized to be insertable through the aperture.

* * * * *